US008726860B2

(12) United States Patent
Kufner et al.

(10) Patent No.: US 8,726,860 B2
(45) Date of Patent: May 20, 2014

(54) ELECTROHYDRAULIC VALVE CONTROLLER

(75) Inventors: Andreas Kufner, Erlangen (DE); Michael Berger, Berching (DE); Calin Petru Itoafa, Hoechstadt (DE)

(73) Assignee: Schaeffler Technologies GmbH & Co. KG, Herzogenaurach (DE)

( * ) Notice: Subject to any disclaimer, the term of this patent is extended or adjusted under 35 U.S.C. 154(b) by 153 days.

(21) Appl. No.: 13/150,358

(22) Filed: Jun. 1, 2011

(65) Prior Publication Data

US 2011/0290204 A1 Dec. 1, 2011

(30) Foreign Application Priority Data

Jun. 1, 2010 (DE) ..... 10 2010 022 346

(51) Int. Cl.
*F01L 9/02* (2006.01)

(52) U.S. Cl.
USPC ..... 123/90.12; 123/90.11; 123/90.13

(58) Field of Classification Search
USPC ..... 123/90.11, 90.12, 90.13
See application file for complete search history.

(56) References Cited

U.S. PATENT DOCUMENTS

| | | | | |
|---|---|---|---|---|
| 6,053,136 | A * | 4/2000 | Albanello et al. | 123/90.16 |
| 2003/0221663 | A1 | 12/2003 | Vanderpoel et al. | |
| 2008/0041329 | A1 | 2/2008 | Stretch | |

FOREIGN PATENT DOCUMENTS

| | | | |
|---|---|---|---|
| DE | 42 06 696 | A1 | 9/1993 |
| DE | 10 2008 049 181 | A1 | 4/2010 |
| JP | 7 019014 | A | 1/1995 |
| WO | 99/23378 | A1 | 5/1999 |

* cited by examiner

*Primary Examiner* — Ching Chang
(74) *Attorney, Agent, or Firm* — Volpe and Koenig, P.C.

(57) ABSTRACT

An electrohydraulic valve controller for variable actuation of a gas exchange valve of an internal combustion engine. The electrohydraulic valve controller has a first hydraulic valve and, for the purpose of providing an emergency running capability, a second hydraulic valve.

5 Claims, 1 Drawing Sheet

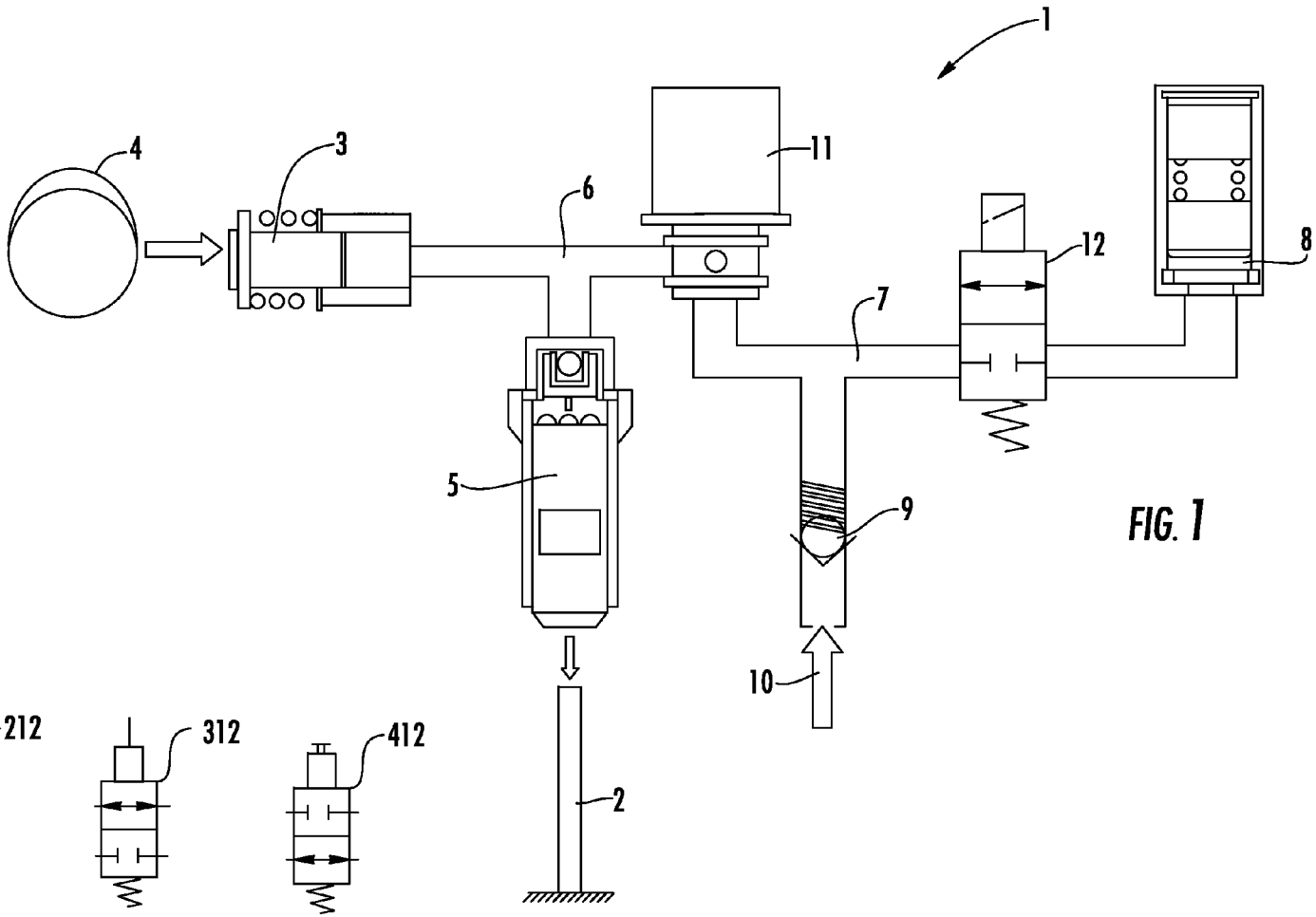
FIG. 1
FIG. 4
FIG. 3
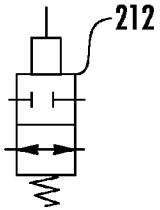
FIG. 2

ELECTROHYDRAULIC VALVE CONTROLLER

CROSS-REFERENCE TO RELATED APPLICATION

This application claims the priority of DE 10 2010 022 346.8 filed Jun. 1, 2010, which is incorporated by reference herein.

FIELD OF THE INVENTION

The invention relates to an electrohydraulic valve controller for the variable actuation of a gas exchange valve of an internal combustion engine.

BACKGROUND OF THE INVENTION

In valve controllers of said type, the variability of the control times and of the maximum lift of the gas exchange valve is attained in that, when the first hydraulic valve is open, a partial volume of the pressure chamber which acts as a so-called hydraulic linkage can be discharged in a continuously variable fashion into the pressure relief chamber, and accordingly the cam lift predefined by the camshaft is transmitted entirely, partially or not at all to the gas exchange valve.

A significant amount of responsibility for the functional reliability of the valve controller is consequently assumed by the first hydraulic valve, the switching function of which must be precisely and reproducibly ensured under all operating conditions of the internal combustion engine. There is however the risk, which can never be entirely eliminated, that the first hydraulic valve, which is open in the deenergized state, suffers a malfunction whereby it no longer closes. The result is an uncontrolled shutdown of the one or more associated gas exchange valves.

With regard to adequate emergency running capabilities of the internal combustion engine (limp-home mode), it is proposed in the generic DE 10 2008 049 181 A1 that the hydraulic system of the valve controller be expanded by a second hydraulic valve which is open during normal operation of the valve controller and closed in the event of a malfunction in order to break the connection from the pressure chamber to the pressure relief chamber. By means of said measure, even if the hydraulic valve is permanently open—for example on account of an electrical power failure or a mechanical defect in the first hydraulic valve—a pressure build-up in the pressure chamber adequate for transmission of lift to the gas exchange valve is made possible by virtue of the second hydraulic valve being closed during emergency running operation and preventing a release of pressure from the pressure chamber.

SUMMARY OF THE INVENTION

The present invention is based on the object of specifying an alternative embodiment of a valve controller of the type specified in the introduction.

The invention relates to an electrohydraulic valve controller for a variable actuation of a gas exchange valve of an internal combustion engine, comprising a master piston driven by a cam, a slave piston driving the gas exchange valve, a variable-volume pressure chamber, which is delimited by the master piston and by the slave piston, a pressure relief chamber which can be connected to the pressure chamber via a control line which is connected to a hydraulic medium supply of the internal combustion engine by a shut-off valve which opens toward the control line, an electrically energizable first hydraulic valve which is arranged in the control line and which forms a connection from the pressure chamber to the pressure relief chamber when the first hydraulic valve is electrically deenergized and the first hydraulic valve breaks the connection when the first hydraulic valve is electrically energized and a second hydraulic valve arranged in the control line and which breaks the connection from the pressure chamber to the pressure relief chamber when the first hydraulic valve is open on account of a fault.

Accordingly, the object is achieved by the second hydraulic valve arranged in the control line such that, if the first hydraulic valve is open on account of a fault, the connection from the pressure chamber to the hydraulic medium supply is produced and the connection from the hydraulic medium supply to the pressure relief chamber is broken.

In other words, the connection from the hydraulic medium supply to the first hydraulic valve is maintained independently of the switching position of the second hydraulic valve. The replenishment of leakage-compensating hydraulic medium from the hydraulic medium supply into the pressure chamber is accordingly not impaired by the switching position of the second hydraulic valve. The bypass line which is required in the prior art cited in the introduction, which bypass line bypasses the two hydraulic valves, which in said prior art are connected in series downstream of the hydraulic medium supply, and produces a direct connection, controlled by means of a check valve, from the hydraulic medium supply to the pressure chamber, can consequently be dispensed with.

In a refinement of the invention, the second hydraulic valve should likewise be electrically energizable, but in contrast to the first hydraulic valve should be designed to be closed in the deenergized state, in order to ensure the required emergency running capabilities of the internal combustion engine even in the event of a power failure at both hydraulic valves.

As an alternative, the second hydraulic valve may also be hydraulically or pneumatically pressure-actuable and may, in both variants, be designed to be open in the unpressurized state or closed in the unpressurized state. The pneumatic valve design may be advantageous in particular in the case of ships' engines which are provided with a compressed air supply for the starting of the engine. In said application, use may furthermore also be made of a manually actuable second hydraulic valve.

BRIEF DESCRIPTION OF THE DRAWINGS

Further features of the invention will emerge from the following description and from the drawings, which schematically illustrate exemplary embodiments of the invention, and in which:

FIG. 1 shows a hydraulic circuit diagram of an electrohydraulic valve controller according to the invention;

FIG. 2 shows a second hydraulic valve designed to be pressure-actuable and open in the unpressurized state, FIG. 3 shows a second hydraulic valve designed to be pressure-actuable and closed in the unpressurized state, and FIG. 4 shows a second hydraulic valve of manually actuable design.

DETAILED DESCRIPTION OF THE DRAWINGS

FIG. 1 shows, in the form of a hydraulic circuit diagram, the essential components of an electrohydraulic valve controller 1 according to the invention for the variable actuation of a gas exchange valve 2 of an internal combustion engine.

The illustration shows a master piston 3, which is driven by a cam 4 of a camshaft, and a slave piston 5, which drives the gas exchange valve 2 which is spring-loaded in the closing direction. The master piston 3 and the slave piston 5 delimit a hydraulic pressure chamber 6 which is connected via a control line 7 to a hydraulic pressure relief chamber 8 in the form of a spring-loaded pressure accumulator. The control line 7 is connected via a shut-off valve 9 to a hydraulic medium supply 10 of the internal combustion engine, and in the present case to the lubricant supply thereof. The shut-off valve 9 is a non-return ball valve which opens in the direction of the control line 7.

A first hydraulic valve 11 which is arranged in the control line 7 and which is designed as a fast-switching electrically actuable 2/2 directional control valve designed to be open in the deenergized state serves, as a function of the state of energization thereof, to produce or break the connection from the pressure chamber 6 to the pressure accumulator 8. Consequently, a hydraulic medium flow through the control line 7 is enabled or blocked, wherein during the actuation of the master piston 3, a continuously adjustable partial volume is discharged out of the pressure chamber 6 into the pressure accumulator 8. The variability of the valve actuation, based on the correspondingly variable hydraulic medium volume of the pressure chamber 6, extends within the limits of, maximum opening lift of the gas exchange valve 2 on the one hand, when the first hydraulic valve 11 is situated in the closed position during the entire stroke phase of the master piston 3, and complete deactivation of the gas exchange valve 2 on the other hand, when the first hydraulic valve 11 is in the open position at least up to the maximum elevation of the master piston 3.

For the situation that the first hydraulic valve 11 remains open during the operation of the internal combustion engine on account of a fault—as mentioned above, one cause for this may be in particular a disrupted power supply to the first hydraulic valve 11—and this would lead to the complete shut-down of the gas exchange valve 2 with correspondingly unacceptable operating behavior of the internal combustion engine, the valve controller 1 comprises a second hydraulic valve 12 which is open during normal, that is to say fault-free operation of the valve controller 1. The emergency running mode of the internal combustion engine based on the switching position of the second hydraulic valve 12 is initiated in that, after it is detected that the first hydraulic valve 11 is open on account of a fault, the second hydraulic valve 12 is closed such that the hydraulic medium pressure which builds up in the pressure chamber 6 can no longer be released into the pressure accumulator 8. In the ideal case of a completely incompressible and leakage-tight pressure chamber 6, the stroke predefined by the master piston 3 is transmitted, corresponding to the maximum opening stroke mentioned in the introduction, to the gas exchange valve 2.

The arrangement of the second hydraulic valve 12 in the control line 7 is such that, when said second hydraulic valve 12 is closed during the emergency running operation, it breaks the connections from the first hydraulic valve 11 and from the hydraulic medium supply 10 to the pressure accumulator 8. In contrast, the connection from the hydraulic medium supply 10 to the pressure chamber 6 is maintained in order to compensate for operational leakages of hydraulic medium from the pressure chamber 6. According to its symbolic illustration, the second hydraulic valve 12 is an electrically energizable 2/2 directional control valve designed to be closed in the deenergized state. During the normal operation of the valve controller 1, the second hydraulic valve 12 is energized so as to be permanently open and to permit the continuously adjustable discharge of hydraulic medium out of the pressure chamber 6 into the pressure accumulator 8.

Alternative designs of the second hydraulic valve are symbolically illustrated in FIGS. 2 to 4.

FIG. 2 shows a pressure-actuated 2/2 directional control valve 212 designed to be open in the unpressurized state.

FIG. 3 shows a pressure-actuated 2/2 directional control valve 312 designed to be closed in the unpressurized state.

FIG. 4 shows a manually actuated 2/2 directional control valve 412.

Considerably lower demands can be placed on the switching speed of the second hydraulic valve 12 than on the first hydraulic valve 11. This is because the second hydraulic valve 12 must switch only once from the open position into the closed position at the start of emergency running operation. Accordingly, the second hydraulic valve 12 can be designed to be significantly cheaper than the considerably faster-switching first hydraulic valve 11.

REFERENCE NUMERALS

1 Valve Controller
2 Gas Exchange Valve
3 Master Piston
4 Cam
5 Slave Piston
6 Pressure Chamber
7 Control Line
8 Pressure Relief Chamber/Pressure Accumulator
9 Shut-Off Valve
10 Hydraulic Medium Supply
11 First Hydraulic Valve
12 Second Hydraulic Valve

The invention claimed is:

1. An electrohydraulic valve controller for the variable actuation of a gas exchange valve of an internal combustion engine, comprising:

a master piston driven by a cam;

a slave piston driving the gas exchange valve;

a variable-volume pressure chamber, which is delimited by the master piston and by the slave piston;

a pressure relief chamber which can be connected to the pressure chamber via a control line which is connected to a hydraulic medium supply of the internal combustion engine by a shut-off valve which opens toward the control line;

an electrically energizable first hydraulic valve which is arranged in the control line and which forms a connection from the pressure chamber to the pressure relief chamber when the electrically energizable first hydraulic valve is electrically deenergized and the electrically energizable first hydraulic valve breaks the connection when the electrically energizable first hydraulic valve is electrically energized; and a second hydraulic valve arranged in the control line and which breaks the connection from the pressure chamber to the pressure relief chamber when the electrically energizable first hydraulic valve is open on account of a fault, wherein the second hydraulic valve is arranged in the control line such that, when the electrically energizable first hydraulic valve is open on account of the fault, the connection from the pressure chamber to the hydraulic medium supply is formed and the connection from the hydraulic medium supply to the pressure relief chamber is broken.

2. The electrohydraulic valve controller according to claim 1, wherein the second hydraulic valve is electrically energizable and when the second hydraulic valve is closed, the second hydraulic valve is electrically deenergized.

3. The electrohydraulic valve controller according to claim 1, wherein the second hydraulic valve is pressure-actuable and is open in an unpressurized state.

4. The electrohydraulic valve controller according to claim 1, wherein the second hydraulic valve is pressure-actuable and is closed in an unpressurized state.

5. The electrohydraulic valve controller according to claim 1, wherein the second hydraulic valve is manually actuable.

* * * * *